US006264155B1

(12) United States Patent
Ardrey

(10) Patent No.: US 6,264,155 B1
(45) Date of Patent: Jul. 24, 2001

(54) ASSEMBLY BASE FOR DECORATIVE TREES

(76) Inventor: Lorna Holly Ardrey, 810 Crystal Ct., Gaithersburg, MD (US) 20878

( * ) Notice: Subject to any disclaimer, the term of this patent is extended or adjusted under 35 U.S.C. 154(b) by 0 days.

(21) Appl. No.: 09/400,441

(22) Filed: Sep. 21, 1999

(51) Int. Cl.[7] ..... F16M 13/00
(52) U.S. Cl. ..... 248/346.01; 269/47
(58) Field of Search ..... 248/346.01, 346.03, 248/346.5, 188.1; 269/47, 296

(56) References Cited

U.S. PATENT DOCUMENTS 4,243,194 * 1/1981 Moore, Jr. et al. ..... 248/188.1
4,253,630 * 3/1981 Rigg ..... 248/346.01

* cited by examiner

*Primary Examiner*—Ramon O. Ramirez
*Assistant Examiner*—Jon Szumny
(74) *Attorney, Agent, or Firm*—J. Halvonik

(57) ABSTRACT

A plastic base form for creating conical-shaped, wire frameworks for decorative Christmas trees and the like. The form has a series of upraised channels and an aperture in each in order for a pin to be inserted in order to secure the wire members and then be removed when the decorative tree has been completed. The channels are arranged around the base into pairs. Such pairs are numbered in order to aid the user in constructing the conical-shaped wire framework when using this base form. Every other pair should be staggered to form two sets of channels, one set forming a small perimeter of about 12" and the other set forming a larger perimeter of about 14". Wire members, such as coat hangers, may then be placed in the channels and secured to one another in order to form the basic conical-shaped, wire framework.

4 Claims, 4 Drawing Sheets

ASSEMBLY BASE FOR DECORATIVE TREES

FIELD AND BACKGROUND OF THE INVENTION

The invention pertains to the field of forms that are used in the crafts field for providing a base form in order to support a wire framework that will turn into the finished product. In this particular invention, the form is used to support a series of wire members, preferably readily available coat hangers, that are held in the form and are then arranged to create a conical-shaped, wire framework that is simulative of Christmas trees.

The finished product is suitable for decoration with lights, garlands etc. in order to produce a final product decorative Christmas tree. The invention provides a base or form that will secure a number of coat hangers in place for standing each hanger in a proper manner and for tying the series of coat hangers or similar wire members to one another in order to create the finished product.

PRIOR ART

While there are inventions that do provide bases for trees, none of the prior art is known to provide a base form for securing wire members such as coat hangers into position in order to form a removable decorative tree. Also, none of the prior art is known to provide a method like the applicant's method for creating decorative trees out of wire construction in the manner provided herein.

SUMMARY OF THE INVENTION

The invention comprises a plastic base form having a series of upraised channels comprised of a pair of parallel walls that form the channels and an aperture in each of the walls in order for a pin to be inserted in order to secure the wire members and then be removed when the decorative tree has been completed. The channels should be arranged around the base in evenly spaced intervals so that the channels are grouped into pairs of such channels and distinguished by members of each pair being directly opposite one another. Such pairs may then be numbered in order to aid the user in constructing the conical-shaped wire framework when using this base form. Every other pair should be staggered to form two sets of channels, one set forming a small perimeter of about 12" and the other set forming a larger perimeter of about 14".

The two pairs that comprise the smaller perimeter set of channels are numbered "1" and "2" and the two pairs that form the larger perimeter set of channels are numbered "3" and "4". Wire members, such as coat hangers, may then be placed in the channels and secured to one another in order to form the basic conical-shaped, wire framework. Additional ornamentation, e.g. lights, garlands, etc. may then be added to the wire framework to enhance the appearance. The finished wire framework may then be removed from the channels.

It is an object of the invention to provide a sturdy base form for holding a series of wire members, such as coat hangers, into position in order to arrange a series of wire members into a conical-shaped, wire framework suitable for decoration as a Christmas tree or similar decorative tree.

Other advantages of the invention will be apparent to those skilled in the art once the invention is shown and described.

DESCRIPTION OF THE PREFERRED EMBODIMENT

The invention comprises a base form (overall view shown in FIG. 1) made of plastic and of rather sturdy construction. Upon the upper surface 2 of this base form are sets of upraised walls 6 separated a short distance from one another to create a "channel" 4. Preferably, there should be eight such channels arranged in a circular shape upon the top of the base to form a roughly circular shape.

Figure 1:
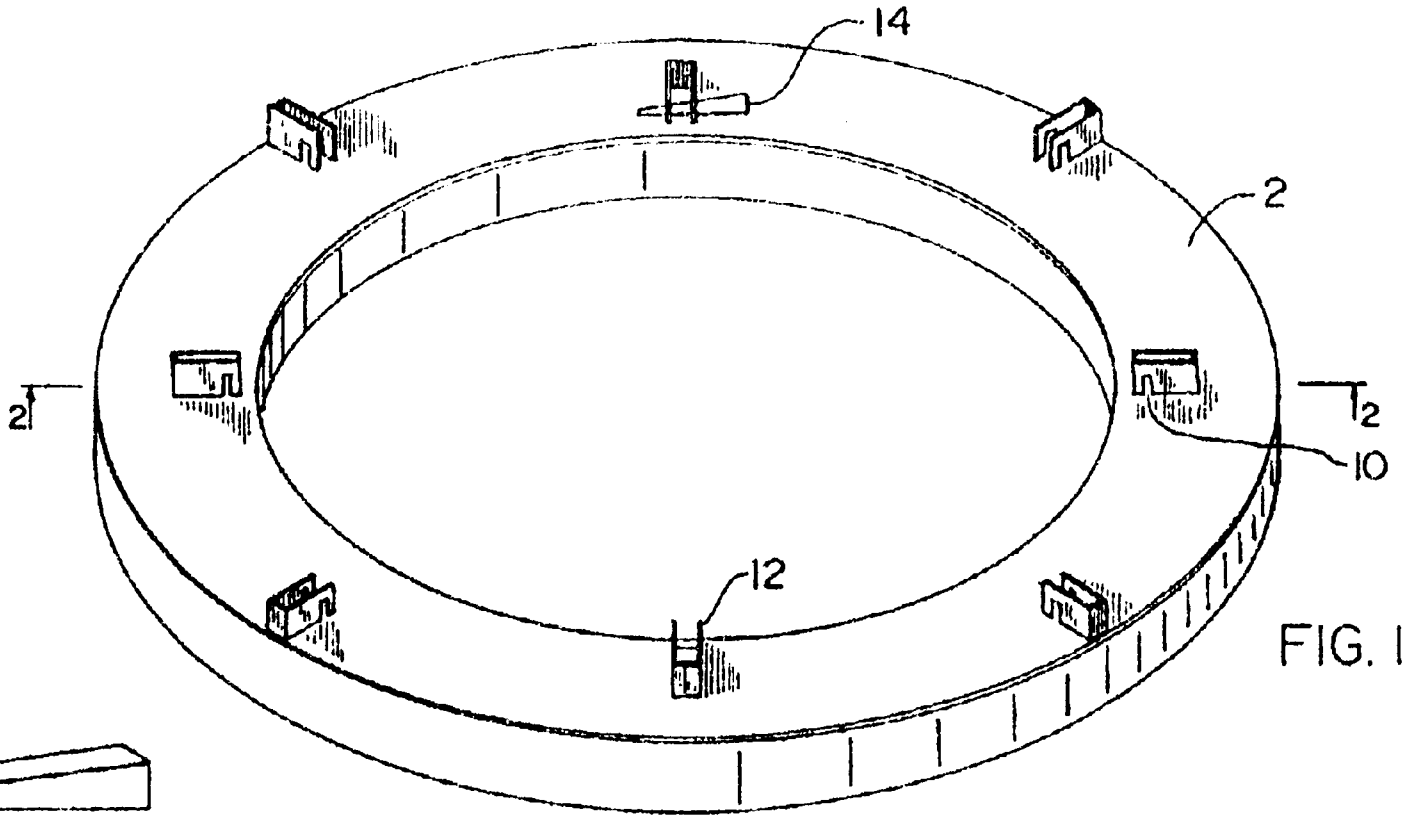
FIG. 1 is a view of the upper surface of the base form.
Figure 2:
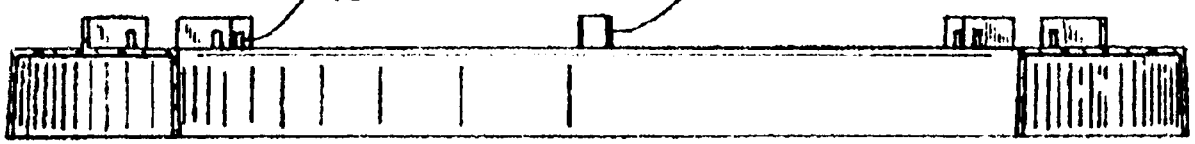
FIG. 2 is a view cross section showing channels and apertures for pins.
Figure 7:
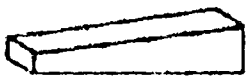
FIG. 7 is a close up of the pin.

The channels themselves should be radially oriented, i.e., the length of the channel and corresponding walls should be aligned along a radius of the circular base as shown in FIG. 1. This is so that wire members 15, such as coat hangers, placed in the channels, will then be oriented so that they will go across the center of the circle formed by the channels. See FIG. 5.

Each of the walls should have an aperture 10 so that a pin (14 in FIG. 1) can be placed in each of walls that comprise the channel, and this pin will then hold the wire members in place during the construction of the decorative tree. When the conical-shaped wire framework has been constructed, additional ornamentation, e.g. lights and garlands, may be added. The finished decorative tree can then be removed from the base form by removing the pins from the apertures.

Figure 6:
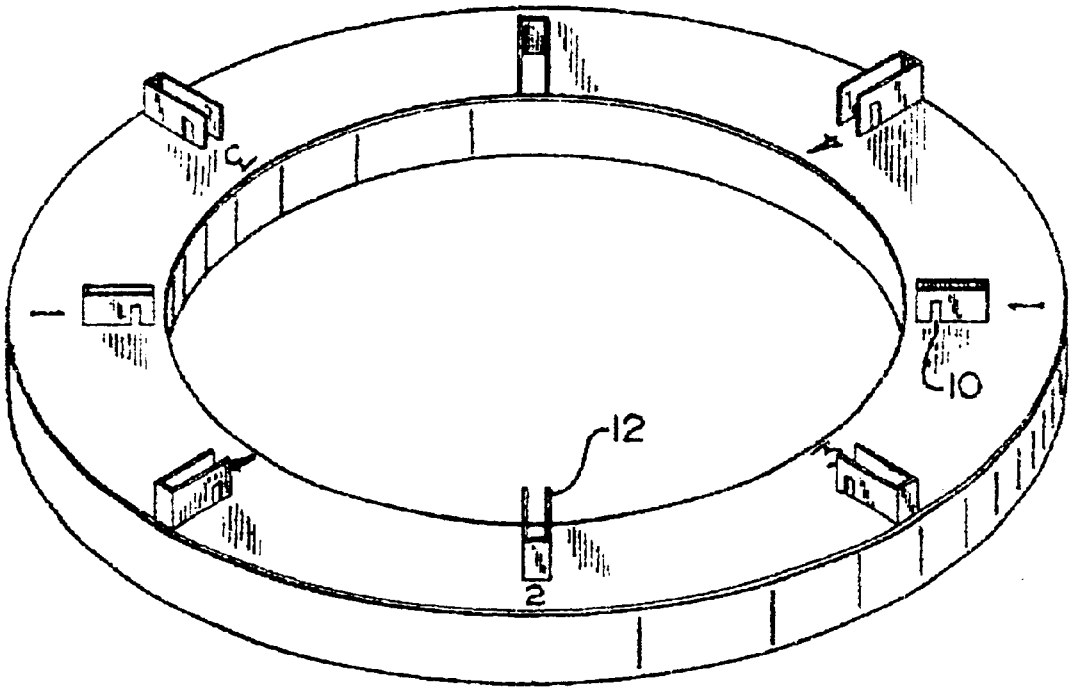
FIG. 6 is a possible numbering system for the channels.

The channels should be arranged about the base in a circular manner and should be spaced evenly apart to ensure that the coat hangers that form the finished product will be uniform in appearance. It is also important that the upright channels be staggered so as to produce two sets of channels with every other channel belonging to the same set. By "staggered" it is meant that one set of channels will be at one distance from the center of the base form and the other set will be at another distance and members of each set will alternate around the perimeter of the base. See FIGS. 1 and 6. One set of channels will be the larger perimeter set and the other set of channels will be the smaller perimeter set.

Thus, the large perimeter set of channels will define a fairly large perimeter (say about 14" in diameter) and the other set of channels will define a somewhat smaller perimeter (say about 12" in diameter when the larger perimeter is 14" in diameter). When eight channels are used, there will thus be two pairs of small perimeter channels, every other channel being of the smaller perimeter, and each member of these channel pairs will face its opposite member. The larger perimeter set of channels will also be staggered, i.e., every other channel will be of the larger perimeter and again, each member of these channel pairs will face its opposite member.

Note: these suggested perimeter sizes are preferred when commercially available coat hangers are used. It is believed that such coat hangers will be most often used in the creation of these decorative trees so these dimensions of the perimeter are preferred as long as coat hangers remain of the same standard size.

The use of two sets of channels that create a larger and smaller perimeter will ensure that half of the wire members will fit beneath the other half in a uniform and space-effective manner. Otherwise there may be a problem in constructing the decorative tree as the coat hangers, being somewhat rigid in nature, will not be able to give way when all of the coat hangers are found to be grouped in the same place in the tree, which would be the case were the channels not to be staggered in their perimeter size. Other methods of staggering the channels may be possible without violating the spirit of the invention.

It is preferred that each pair of channels be numbered starting with the number "1". Number "1" channel should be one of the pairs on the small radius and the number "2" channel should also be on the smaller radius. In the case of eight channels, this will be the only other small pair of channels. Numbers "3" and "4", channel pairs should be those channels on the larger perimeter. The numbering is used to help the user determine the order of the placement of the wire members in the base channels, with number "1" being the channel pair for the first pair of wire members. See FIG. 6.

INSTRUCTIONS FOR USING THE BASE

Figure 5:
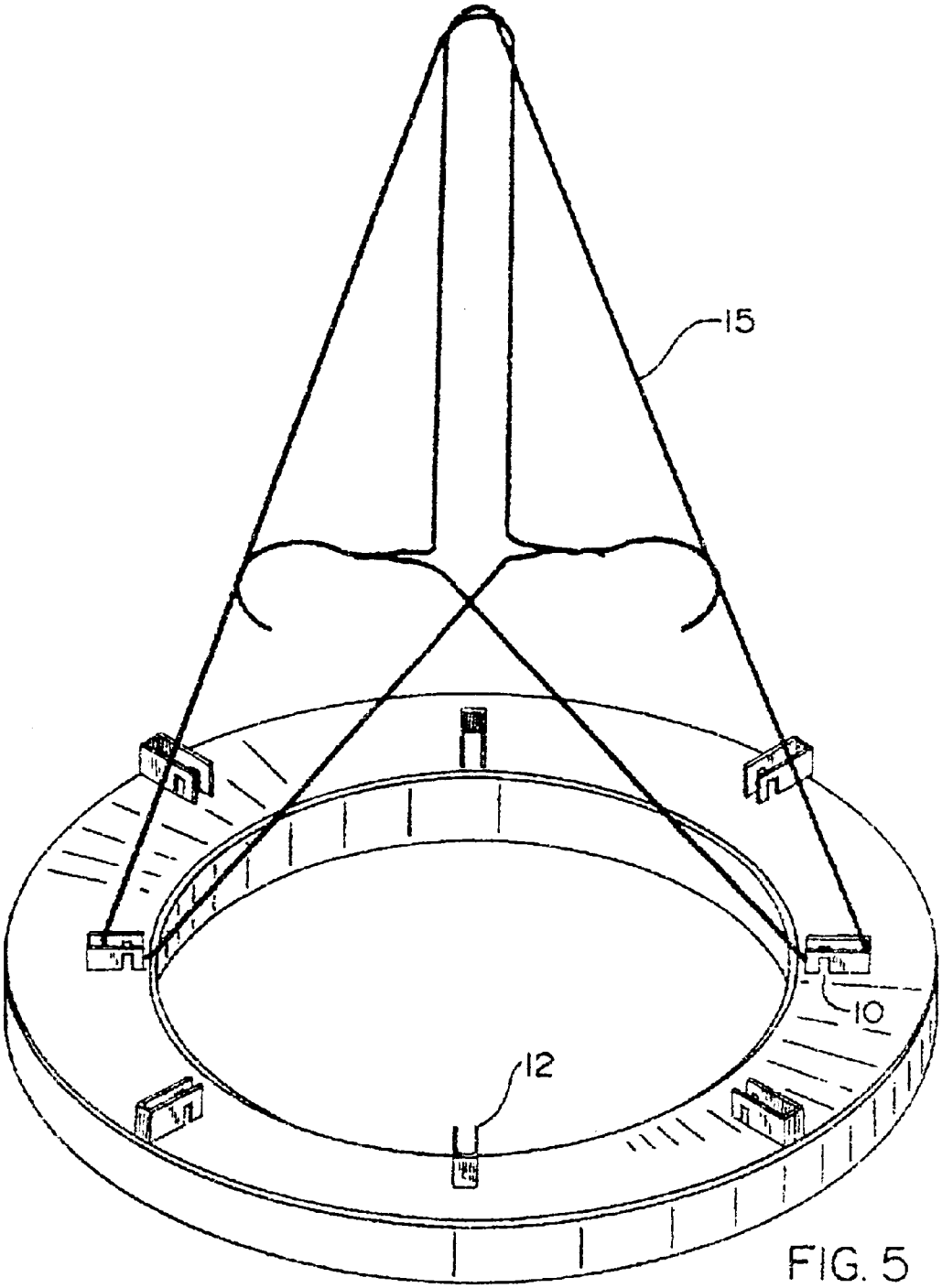
FIG. 5 is a view of the device with initial placement of coat hangers.

Insert a wire hanger into each member of the channel pair numbered "1" with the curve of the hanger necks facing down and secure the hangers by placing the pins into the apertures in the channel walls. Join the hangers together at the top with a "5" twist tie. Repeat this process with hangers in each member of the channel pairs numbered "2", "3", and "4" (in that order) joining all hangers together at the top. FIG. 5 shows the work in progress with two coat hangers 15 already in the channels.

Then squeeze all the hangers together in the center and join them with a 6" twist tie. Attach the eight hanger necks to the long sides of the hangers by using 4" twist ties.

Attach lights to long sides of hangers starting with the first light at the plug end of the light string attached to the hanger near the bottom of channel number "1". Use "4" twist ties for this process. The user should attach each light on the string by going first up one hanger and down the next, etc. Three of these passes will take the user to the top of a hanger, at which point a light should be attached to the top of the hangers before proceeding down the next hanger. When complete, there should be four lights on each long side of the conical-shaped, wire framework and three lights at the very top. The same twist ties used to attach the hanger necks will be used to attach one of the four lights on each of the long sides of the eight hangers. Leftover lengths of ties can be wrapped around the hangers for a smooth finish.

Garlands should be secured around the top of the tree between the hangers and wound around the conical-shaped wire framework until you reach the bottom of the tree. Wrap this snugly ensuring that the lights remain extended to the outside of the wire framework. Remove the tree from the base form by removing the aperture pins. Grip the hangers at the bottom, one at a time, and lift the tree from the channels, moving from one channel to the next around the base form, until the hangers are free of the channels. Additional decorations, e.g. beads, a tree topper, or hanging decorations can then be added.

GENERAL COMMENTS ON THE APPARATUS

It is preferred that the base be made in a circular form with an outer wall of circular shape and a removed portion in the middle to create a circular look. The upraised channels are then arranged upon the top surface of the circular portion. However, such shape is not necessary to the function of the form and other shapes are possible without violating the spirit of the invention. This includes square or rectangular shapes with no portion removed from the middle or with some portion removed. Other shapes are also possible without detracting from the spirit of the invention.

It is thought that the base can be made out of many different materials including wood and plastic as they are commonly available materials. It is preferred that the base be made out of a durable plastic such as PVC (polyvinyl chloride) or similar types of sturdy materials.

While it is preferred that the base form have eight upraised channels, it is possible to have more or less channels depending on the particular type of construction that is desired. Probably six channels would be the minimum number of channels that can be used so that the resulting construction is a conical-shaped, wire framework that uses only six wire members. Of course a greater number of channels will create a wire framework with a larger number of wire coat hangers in use. Such construction is also possible depending on how much effort and expense (in terms of coat hangers) the users wishes to invest.

Figure 3:
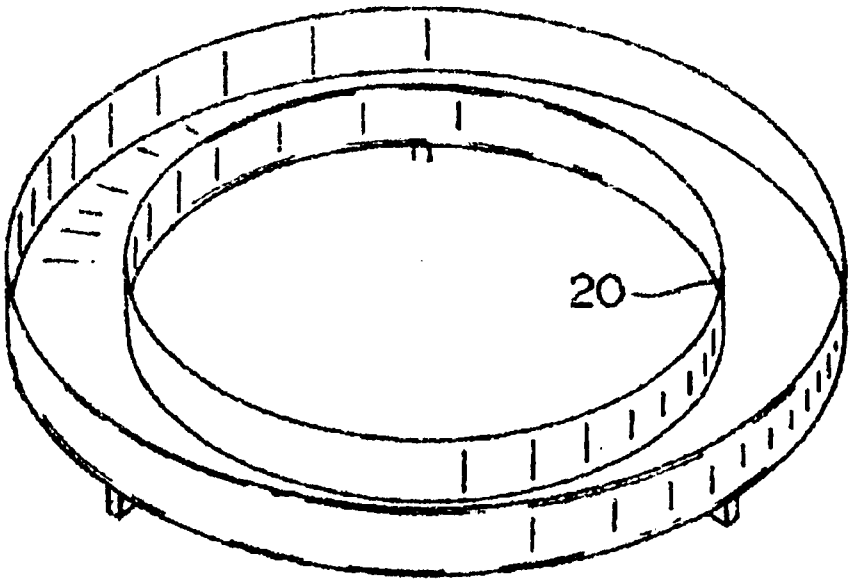
FIG. 3 is a view of the bottom of the base form showing apertures for injection molding process used to form the channels.
Figure 4:
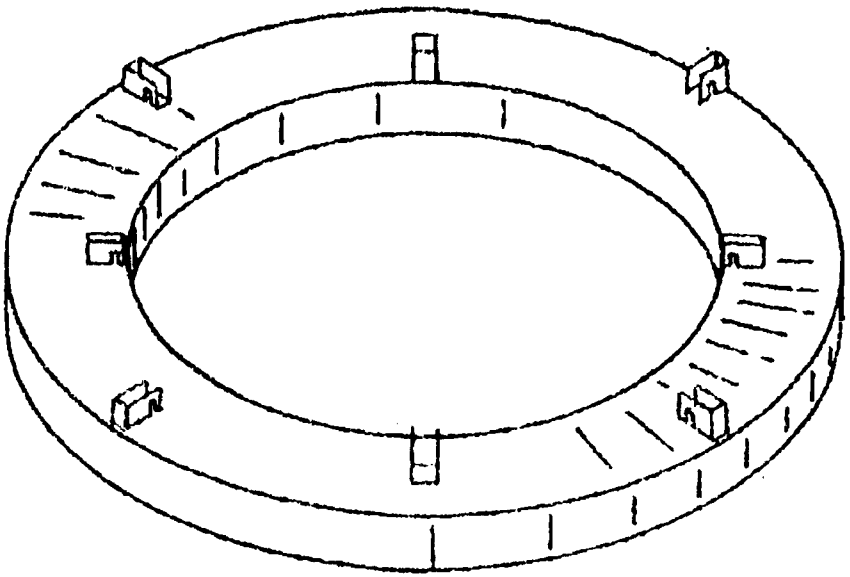
FIG. 4 is a perspective view of top of the base form.

Note; underside view in FIG. 3 shows holes 20 used in the injection molding process for plastic and are not a prerequisite for the invention to function in its intended purpose.

I claim:

1. A base form apparatus for securing wire members such as coat hangers in a circular arrangement for creating a conical-shaped, wire framework simulating a Christmas tree, said apparatus comprising: a base member of sturdy material and having an upper surface, said upper surface having an even number of upraised channel members in connection with said upper surface, said channel members forming two groups of channels, a first inner group and a second outer group, both of said groups being arranged in a circular fashion and having a common center point, said outer group and said inner group arranged inside of one another so that said outer group has a larger circumference and a larger diameter than said inner group; each of said channels in a given group being arranged in pairs so that each member of said pair is opposite the other member of said pair, each of said members of said groups arranged in alternating fashion about said upper surface so as to alternate a member of said outer group and then a member of said inner group, each of said channel members comprising a pair of spaced-apart walls raised above said upper surface of said base so as to form an open space in between said walls, each of said walls perpendicular to said circumferences of said groups, each of said walls having an aperture so that a pin can be placed within said aperture for holding said wire members when said members are placed within said walls.

2. The apparatus of claim 1 wherein said upper surface has at least eight channel members, each said pair of channel members associated with a numeral chosen from a series of numerical indicia, said numeral in connection with said base surface and said numerical series starting with the numeral "1" and going up to at least numeral "4," so that said channel pairs associated with said numerals "1" and "2" comprise a pair of channels in said inner group of channels and channel pairs associated with said numerals "3" and "4" comprise a pair of channels in said outer group of channels.

3. The apparatus of claim 2 wherein said apertures are spaced above said upper surface for a distance sufficient to permit the wire coat hanger to be fit beneath said pin and to be snugly held by said pin upon said upper surface.

4. The apparatus of claim 2 wherein said diameter of said outer group is about 14" an aid diameter of said inner group is about 12".

* * * * *